US010497523B2

(12) United States Patent
Wong

(10) Patent No.: US 10,497,523 B2
(45) Date of Patent: Dec. 3, 2019

(54) ELECTRICAL SWITCH FOR AN ELECTRICAL DEVICE AND SEALING ASSEMBLY FOR AN ELECTRICAL SWITCH

(71) Applicants: Dongguan Chen Da Appliance Co. Ltd., Guangdong (CN); Defond Components Limited, Chai Wan (HK)

(72) Inventor: Kin Yu Wong, Chai Wan (HK)

(73) Assignees: Defond Electech Co., Ltd., Dongguan (CN); Defond Components Limited, Chai Wan (HK)

( * ) Notice: Subject to any disclaimer, the term of this patent is extended or adjusted under 35 U.S.C. 154(b) by 0 days.

(21) Appl. No.: 15/728,852

(22) Filed: Oct. 10, 2017

(65) Prior Publication Data

US 2018/0144888 A1 May 24, 2018

(30) Foreign Application Priority Data

Nov. 24, 2016 (HK) ..... 16113455

(51) Int. Cl.
*H01H 15/10* (2006.01)
*H01H 15/02* (2006.01)
*H01H 9/04* (2006.01)

(52) U.S. Cl.
CPC ..... *H01H 15/10* (2013.01); *H01H 15/02* (2013.01); *H01H 9/041* (2013.01); *H01H 2009/048* (2013.01); *H01H 2223/002* (2013.01)

(58) Field of Classification Search
CPC ..... H01H 15/10; H01H 9/041; H01H 15/02; H01H 2009/048; H01H 2223/002
USPC ..... 200/302.1
See application file for complete search history.

(56) References Cited

U.S. PATENT DOCUMENTS

| | | | | |
|---|---|---|---|---|
| 3,334,200 | A | 8/1967 | Moore et al. | |
| 3,723,692 | A * | 3/1973 | Wilbrecht | H01H 13/06 200/302.1 |
| 3,778,577 | A | 12/1973 | Fromknecht et al. | |
| 6,313,420 | B1 * | 11/2001 | Ohashi | H01H 15/06 200/302.1 |
| 2007/0272535 | A1 | 11/2007 | Sloan et al. | |

FOREIGN PATENT DOCUMENTS

| | | | |
|---|---|---|---|
| CN | 2641795 | Y | 9/2004 |
| CN | 2650314 | Y | 10/2004 |
| CN | 1973808 | A | 6/2007 |
| CN | 200990324 | Y | 12/2007 |
| CN | 202678177 | U | 1/2013 |
| DE | 1849285 | U | 4/1962 |

(Continued)

*Primary Examiner* — Edwin A. Leon
*Assistant Examiner* — Lheiren Mae A Caroc
(74) *Attorney, Agent, or Firm* — Kolisch Hartwell, P.C.

(57) ABSTRACT

A sealing assembly for prevention of ingress of particulates and water into an electrical switch includes an engagement element with a rigid first abutment portion for circumscribing an aperture extending through the outer surface of the switch housing and a rigid first retention portion. Also included is a sealing element being slidingly engageable with the engagement element that includes a first complementary abutment portion. The sealing element is formed from an elastically resilient polymeric material so that sealing engagement with the engagement element occludes passage and ingress of external particulates, dust and water.

18 Claims, 11 Drawing Sheets

(56) References Cited

FOREIGN PATENT DOCUMENTS

| | | | |
|---|---|---|---|
| DE | 1242736 | B | 6/1967 |
| DE | 4115924 | C1 | 6/1992 |
| EP | 0694939 | A1 | 1/1996 |
| JP | 2009009900 | A | 1/2009 |

* cited by examiner

ELECTRICAL SWITCH FOR AN ELECTRICAL DEVICE AND SEALING ASSEMBLY FOR AN ELECTRICAL SWITCH

TECHNICAL FIELD

The present invention relates to the field of electrical switch units, and in particular relates to electrical switches for use in electrical devices, in particular for use in hand-held or portable devices such as power tools and personal care devices.

BACKGROUND OF THE INVENTION

Hand-held electrical devices such as power tools or personal care devices include electric switch units which assist in controlling the supply of power to the motor or other electrically operable elements of the electrical device.

It is of paramount importance that due to environmental factors, that such switches prevent ingress of foreign particulates, dust and water. This is due to longevity of a switch, which typically may be used for numerous cycles when implemented in such an electrical device. Also and importantly, from an occupational health and safety risk standpoint, it is important that ingress of foreign matter and water be prevented from entering a switch, as the ingress of such matter can cause short circuiting as well as electric shock to an operator. Further, such ingress may cause an insulative effect, and cause non-operability of a switch, rendering a device in which the switch is implemented non-operable.

Within the various electrical standards, there exist requirements of prevention of ingress of foreign objects and water, of varying degrees, and applicable ratings are applied to switches depending upon the level of ingress prevention. For example, standards may include ratings or gradings dependent upon the size of particulates of sizes, dust-proofing, and the pressure of water such as from dripping, spraying, powerful water jets, temporary immersion and long term immersion.

Accordingly, depending upon the physical and environmental application, a switch or switch assembly is required to have the requisite level of particulate, dust and water prevention to ingress rating.

For example, hand operable power tools are often exposed to harsh environments such as construction or work sites, whereby there is inherently a high level of dust and particulate matter, as well as often moisture and water. Further, an operator of e device may have wet hands or gloves with liquid thereon, such as uncured cement or wet paint, which needs to be prevented from entering the switch or switch assembly. Also, a power tool when not used may be laid down in a wet or moist environment or be exposed to the splashing of water.

In other applications such as personal care devices, for example hairdryers, inherently there will exist airborne particulate matter as well as water from the hair of an operator or wet surfaces upon which a hairdryer or other device may be laid to rest. Accordingly, from longevity and safety standpoints, ingress into the switch or switch assembly of particulates, dust and water must be suitably resisted or prevented.

There exist various manners in which a switch may be dust proofed or water proofed according to the prior art, such as an encapsulating membrane covering at least the outer exposed portion of the switch including the actuator. However such membranes, through repetitive use and deformation, may tear or become perforated, and permit ingress of particulates, dust and water, and thus have compromised integrity.

Further, the use of such switches or switch assemblies are often bulky, and their implementation in hand-held electrical devices such as hand operable power tools and hand-held personal care devices is often precluded, due to physical space constraints and aesthetic requirements.

Switches as applicable for use in hand-held electrical devices such as hand operable power tools and hand-held personal care devices must not be easily inadvertently activated or requisite settings or positions easily inadvertently altered, due to safety concerns as well as commercial implications.

OBJECT OF THE INVENTION

It is an object of the present invention to provide an electrical switch for an electrical device and sealing assembly for an electrical switch which overcomes or ameliorates at least some of the deficiencies as associated with the prior art.

SUMMARY OF THE INVENTION

The present invention may involve several broad forms. Embodiments of the present invention may include one or any combination of the different broad forms herein described.

In a first aspect, the present invention provides a sealing assembly for prevention of ingress of particulates and water into an electrical switch having two or more positions moveable between a first extremity and a second extremity in a linear direction of movement by an actuator, whereby said actuator is operable through an aperture extending through the outer surface of a housing of the electrical switch, said sealing assembly comprising:

- an engagement element including a rigid first abutment portion for circumscribing the aperture extending through the outer surface of the housing of the switch and a rigid first retention portion;
- a sealing element being slidingly engageable with the engagement element in a direction of said linear direction of movement of the actuator and being retained by the retention portion of the engagement element, said sealing element including a first complementary abutment portion for sliding engagement with the first abutment portion of the engagement element;
  - wherein the sealing element is formed from an elastically resilient polymeric material such that when retained by the engagement element, sealing engagement between the first complementary abutment portion of the sealing element and the first abutment portion is effected as the first complementary abutment portion is urged against the first abutment surface of the engagement element so as to occlude passage and ingress of particulates, dust and water from external of the first abutment portion to the aperture extending through the outer surface of a housing of the electrical switch; and
  - wherein upon movement of the sealing element in conjunction with movement of the actuator of the electrical switch between the first extremity and the second extremity, said sealing engagement between the first complementary abutment portion of the sealing element and the first abutment surface of the engagement element is maintained.

In an embodiment of the present invention, the first abutment portion of the engagement element protrudes from and extends in a direction of outwardly away from the outer surface of the housing.

The first abutment portion may further prevent ingress of water from the surface of the housing external of the surface of the housing into the switch via the aperture.

The first abutment portion may further extend in a direction away from the aperture so as to form a rebate between the outer surface of the housing of the electrical switch and the first abutment portion, to further prevent ingress of water from the surface of the housing external of the surface of the housing into the switch via the aperture.

The retention portion may prevent ingress of water from the surface of the housing external of the surface of the housing into the switch via the aperture.

In an embodiment of the present invention, the retention portion of the engagement element is provided as a rail assembly which protrudes from and extends in a direction of outwardly away from the outer surface of the housing.

The rail assembly is preferably provided by a pair of elongate rail members, wherein each rail member is of elongate form and is disposed on the outer surface of a housing of the electrical switch and extend in the direction of said a linear direction of movement on opposed sides of the aperture.

Preferably, each rail member includes an elongate protrusion extending along at least a portion of the length of each rail, wherein each elongate protrusion extends in a direction of away from the aperture of the housing such that a retention rebate is formed between each rail and the outer surface of the housing; and wherein the sealing element includes a pair of complementary protrusions each of which extends within the rebate of each rail member such that the sealing element is retained to the retention portion of the engagement element.

The retention rebates may further prevent ingress of water from the surface of the housing external of the surface of the housing into the switch via the aperture.

In an embodiment of the present invention, the engagement element includes a rigid further abutment portion and the sealing element includes a further complementary abutment portion for sliding engagement with the further abutment portion of the engagement element, wherein retention of the sealing element by the engagement element causes sealing engagement between the further complementary abutment portion of the sealing element the further abutment surface and the further abutment surface as the further complementary abutment surface is urged against the further abutment surface of the engagement element so as to further occlude passage and ingress of particulates, dust and water from external of the further abutment portion to the aperture extending through the outer surface of a housing of the electrical switch.

The further abutment surface may be provided by the outer surface of the housing of the switch, and the further complementary abutment surface may be a protrusion extending from the sealing element in a direction of towards the outer surface of the housing of the switch and circumscribing the aperture of the housing of the switch.

The sealing element is preferably formed from an elastically resilient polymeric material including those selected from the group including a urethane such as thermoplastic polyurethane, synthetic rubber, silicone, a silicone rubber or the like.

The actuator of the switch is operable by urging an actuation portion in communication with the actuator which extends through the aperture in the linear direction of movement by a user.

In an embodiment of the present invention, the actuation portion extends through the sealing element and the sealing element is sealing engaged and affixed to the actuation portion so as to occlude passage and ingress of particulates, dust and water from external of the housing of the switch through the outer surface of a housing of the electrical switch.

Urging of the actuation portion may urge the actuator and the sealing element in the direction of movement. Alternatively, urging of the sealing element in the direction of movement may urge the actuation portion which urges the actuator in the direction of movement.

In another embodiment of the present invention, the sealing element may extend over the actuation portion, such that the actuation portion is encapsulated between the sealing element and internal of the housing.

Urging the actuation portion by through the sealing element, the actuator may be urged in the direction of movement and the sealing element is urged in the direction of movement by the actuation portion. Alternatively, urging of the sealing element in the direction of movement urges the actuation portion may urge the actuator in the direction of movement.

In a further embodiment of the present invention, the engagement element may be integrally formed with a housing of an electrical switch.

In an alternate embodiment of the present invention, the engagement element may be affixable to a housing of an electrical switch by snap-fit, ultrasonic welding, adhesive, rivet or the like.

In a second aspect, the present invention provides an electrical switch including a sealing assembly according to any one of the preceding claims.

In a third aspect, the present invention provides an electrical switch comprising:

a housing;

one or more stationary contacts disposed within said housing, wherein each one or more stationary contacts being in electrical communication with a terminal, and one or more moveable contacts moveable within said housing, said one or more moveable contacts being moveable and engageable with one or more of said more stationary contacts so as to provide electrical communication between a terminal of said more stationary contacts and a terminal in electrical communication with said one or more moveable contacts; and an actuator assembly disposed within said housing and being movable in a linear direction of movement between a plurality of predefined operable positions upon being urged in said direction of movement; said actuator assembly including:

a locking mechanism for retaining the actuator assembly at each operable position of said plurality of operable positions, wherein the locking mechanism includes a biasing arrangement for retaining the actuator assembly at each operable position and having a predetermined retention load, and whereby upon the actuator is urged in the direction of movement at a load which overcomes the retention load, retention of the actuator assembly is overcome and the actuator assembly is moveable to an adjacent operable position; and a biasing assembly including one or more biasing elements for urging at one or more moveable contacts against a contact of one or more of said more stationary contacts when the actuator assembly is moved to located at an operable position, so as to provide an electrical communication between respective contacting moveable and stationary contacts and so as to provide electrical communication between the terminal of the stationary contact and a terminal in electrical communication with the moveable contact;

wherein the predetermined retention load of the locking mechanism is determined based upon a requisite force above which the actuator assembly is permitted to be moved to an adjacent operable position; and wherein the biasing assembly maintains the contact load between movable and stationary contacts with a predetermined contact load range during engagement of contacts, disengagement of contacts and whilst contacts are operatively engaged, wherein the predetermined contact load range determined based upon requisite operational parameters of the contacts.

The locking mechanism preferably includes a detent arrangement. The detent arrangement may be provided by at least one compression spring and at least one corresponding a bullet element and in conjunction with a recess element having a plurality of recesses extending there along, whereby the recess element is affixedly engaged with the housing and wherein each recess defines an operable position of the switch, such that upon the bullet being urged into a recess of the recess element by the compression spring, the actuation assembly is retained at the operable position.

Alternatively, the detent arrangement is provided by a biasing arm element having a bullet portion and in conjunction with a recess element having a plurality of recesses extending there along, whereby the recess element is affixedly engaged with the housing, wherein the biasing arm element includes a distal bullet portion which, when urged by the biasing arm element into a recess, the actuation assembly is retained at the operable position. The biasing arm element is preferably formed from a polymeric material, the elastic properties thereof which provide a biasing force for urging the bullet portion into the recess. The biasing arm element may be unitary formed with the actuation assembly. In an embodiment, the detent arrangement includes two detent arrangements, each of which are equidistantly spaced from the biasing elements of the biasing assembly.

In an embodiment, the switch includes a lever element, said lever element carrying thereon a first movable contact at a first end of the lever element and a second moveable contact at the opposed end of the lever element, said lever element being pivotably supported within the housing, wherein upon the actuator being urged towards a first end of the switch, the biasing element of the biasing assembly is urged against the lever so as to urge the first moveable contact towards an adjacent stationary contact; and upon the actuator being urged towards the opposed end of the switch, the biasing element of the biasing assembly is urged against the lever so as to urge the second moveable contact towards an adjacent stationary contact.

In another embodiment, the switch further includes a conduction element carrying two or more moveable contacts, wherein the conduction element is moveable in the direction of movement in response to movement of the actuator assembly, and provides electrical communication between two stationary contacts.

In a fourth aspect, the present invention provides an electrical switch assembly comprising the electrical switch according to the third aspect and the sealing assembly according to the first aspect.

BRIEF DESCRIPTION OF THE DRAWINGS

The present invention will become more fully understood from the following detailed description of a preferred but non-limiting embodiment thereof, described in connection with the accompanying drawings, wherein.

DETAILED DESCRIPTION OF THE PREFERRED EMBODIMENTS

Figure 1A:
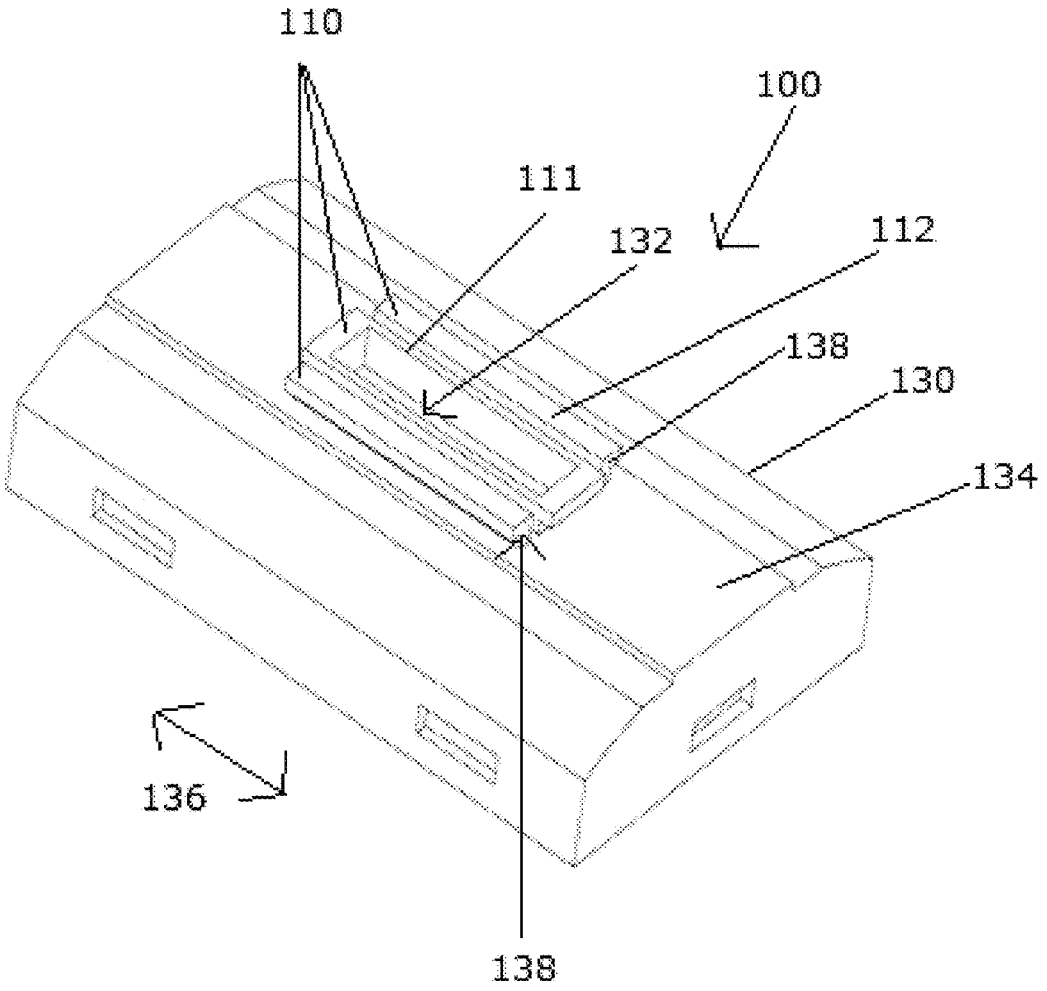
FIG. 1*a* depicts a perspective view of an example of an engagement element of a sealing assembly according to the present invention in conjunction with a housing of an electrical switch.
Figure 1B:
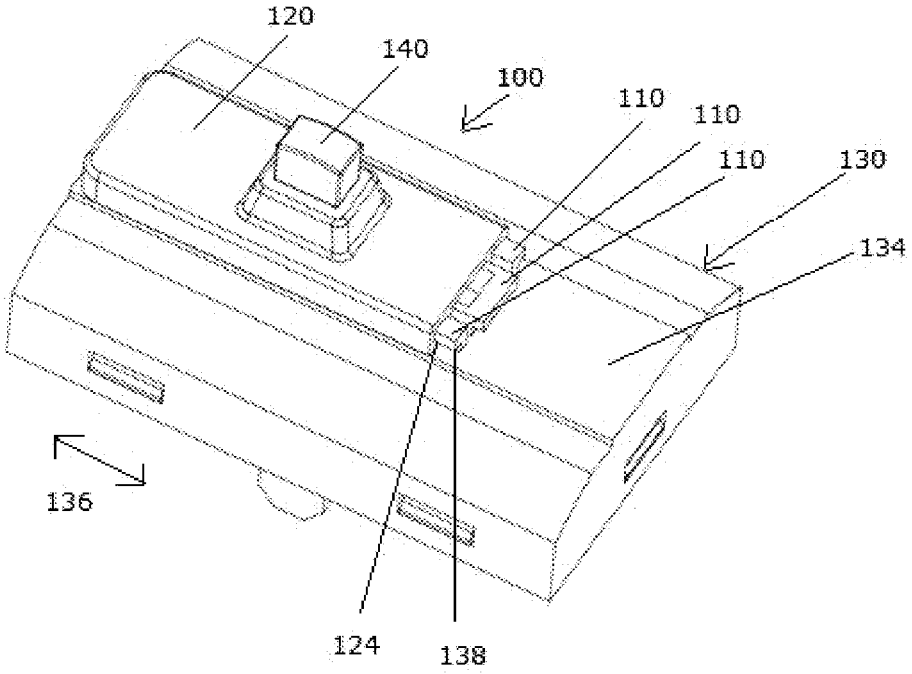
FIG. 1*b* depicts a perspective view of the housing member of FIG. 1*a* in conjunction with an electrical switch and in conjunction with an example of a sealing assembly according to the present invention shown in partial section which is engaged with the engagement element of FIG. 1*a;*
Figure 1C:
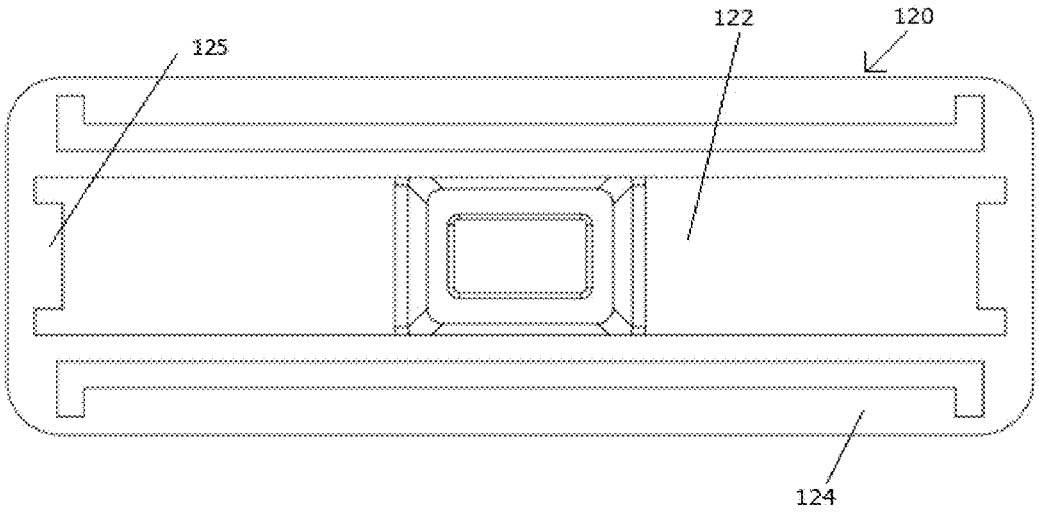
FIG. 1*c* depicts a bottom view of a sealing element of FIG. 1*b* for engagement with the engagement element of FIG. 1*a;*
Figure 1D:
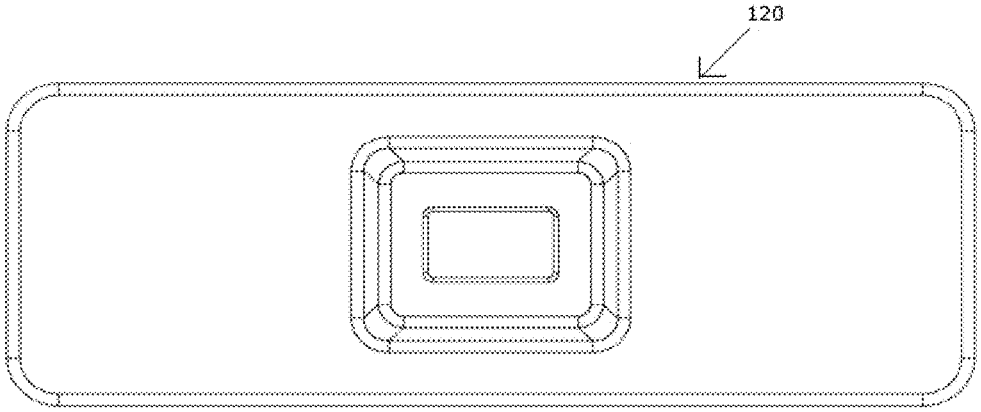
FIG. 1*d* depicts a top view of the sealing element of FIG. 1*c;*
Figure 1E:
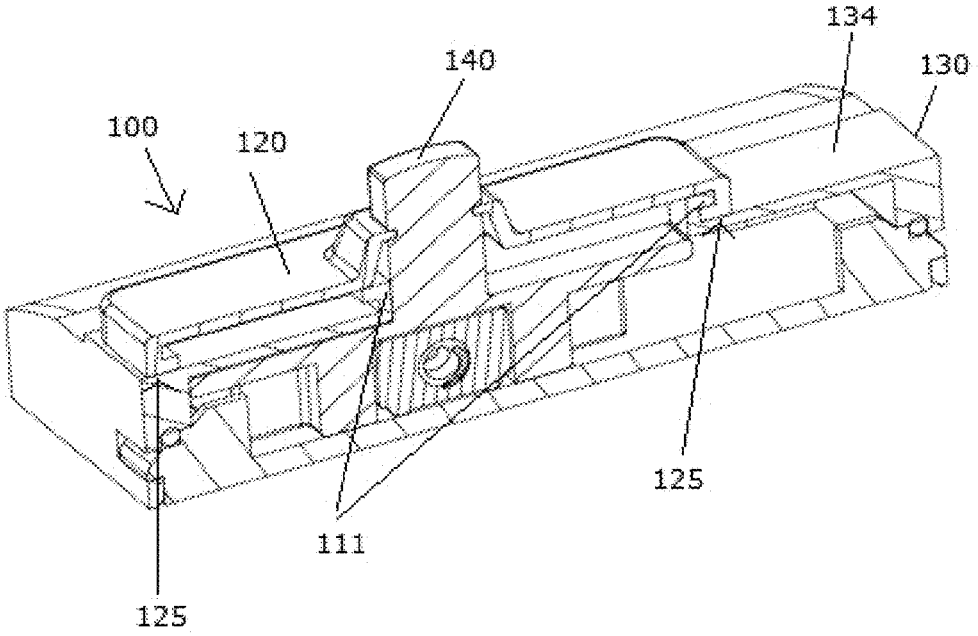
FIG. 1*e* depicts a perspective sectional view of the sealing assembly and housing and switch of FIG. 1*b* with an actuator for an electrical switch at a first extremity of linear movement.
Figure 1F:
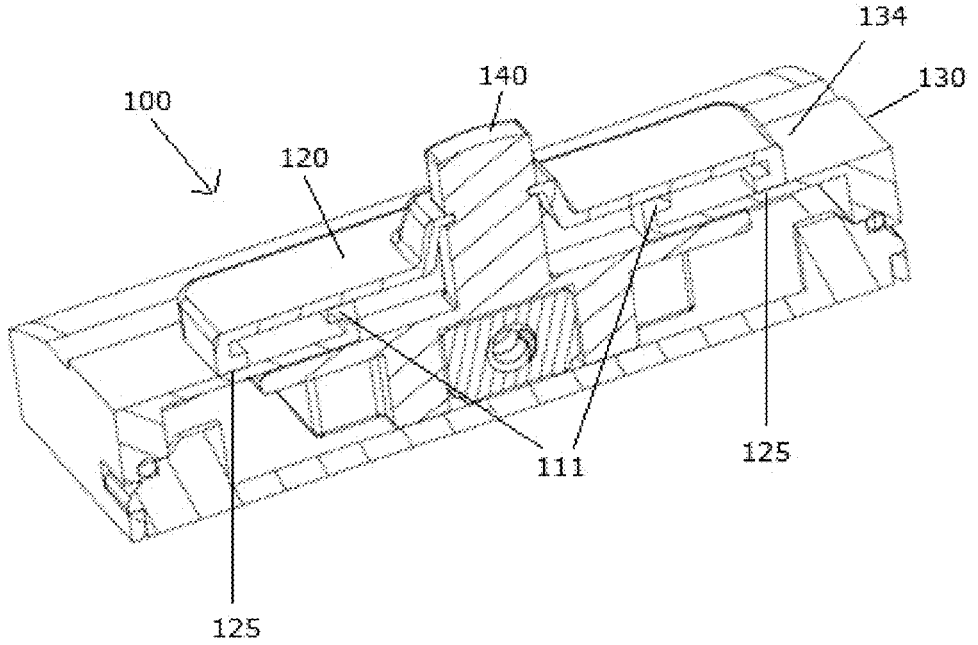
FIG. 1*f* depicts a perspective sectional view of the sealing assembly and housing and switch of FIG. 1*e* with the actuator at a midpoint of linear movement.
Figure 2A:
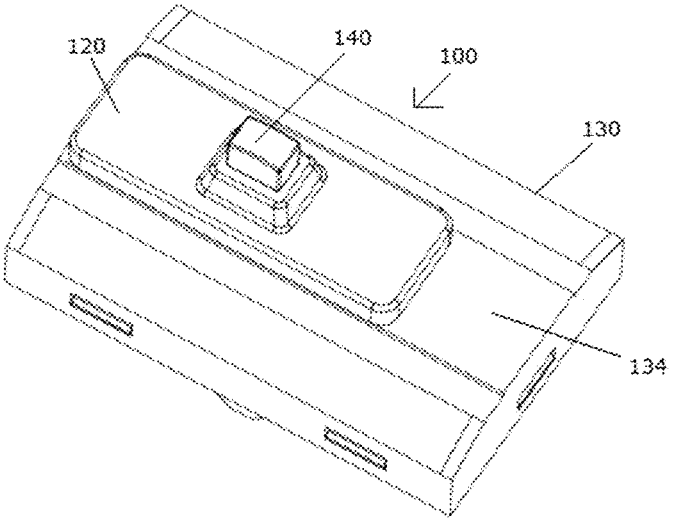
FIG. 2*a* depicts a perspective view of the sealing assembly, housing and switch of FIG. 1*b*, with an actuator for an electrical switch at a first extremity of linear movement.
Figure 2B:
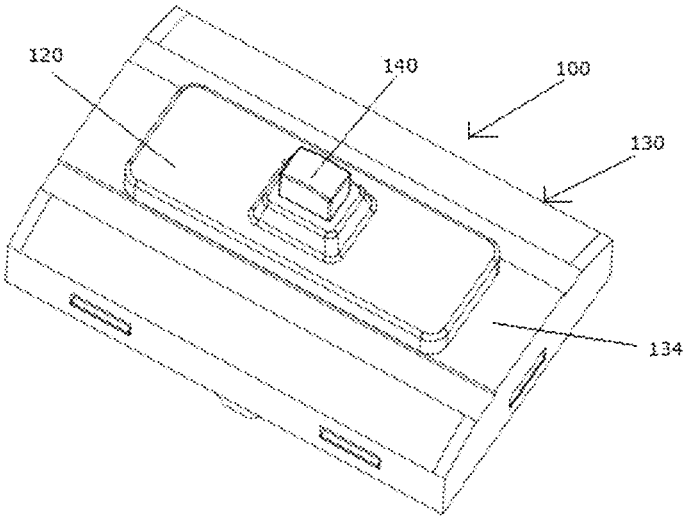
FIG. 2*b* depicts a perspective view of the sealing assembly, housing and switch of FIG. 1*b*, with an actuator for an electrical switch at a mid-point of linear movement.
Figure 2C:
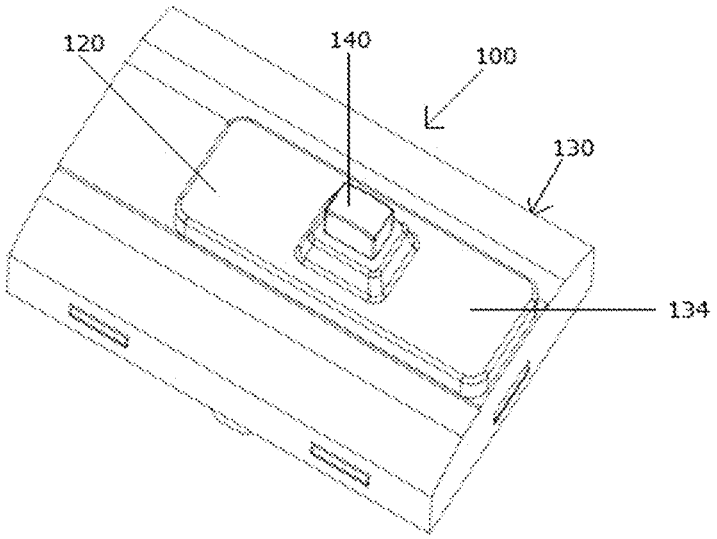
FIG. 2*c* depicts a perspective view of the sealing assembly, housing and switch of FIG. 1*b*, with an actuator for an electrical switch at a second extremity of linear movement.

Referring to FIGS. 1*a* to 2*c*, there is shown an exemplary embodiment of a sealing assembly 100 for the prevention of ingress of particulates, dust and water into an electrical switch in accordance with the present invention when incorporated with an electrical switch which is suitable for use in hand-held electrical devices such as hand operable power tools and hand-held personal care devices.

The sealing assembly 100 is applicable to electrical switches which may have 1 or 2 poles and 2 or more positions, whereby the actuator of the switch is moveable in a linear direction of movement 136 between a first extremity which corresponds to a first pole, to a second extremity which corresponds to a second extremity.

The actuator of such a switch is operable through an aperture 132 which extends through the outer surface 134 of a housing 130 of the electrical switch. In order to move such an actuator in the direction of movement 136, the actuator 140 is urged by the user of the hand-held electrical device, either directly or indirectly, which may be by direct or indirect contact with the actuator 140, or by direct or indirect contact with an element in operable communication with the actuator 140. As will be understood by those skilled in the art, there exist numerous manners in which an actuator 140 of an electrical switch may be operated, and no structural limitation should be imported to the invention by reference to the exemplary embodiments.

The sealing assembly 100 comprises an engagement element 110 to which a sealing element 120 is slidingly engaged with, such that the sealing element 120 is moveable in a linear direction of movement 136.

The engagement element 110 includes a first rigid first abutment portion 111 which circumscribes the aperture 132 which extends through the outer surface 134 of the housing 130 of the switch, and also includes a rigid first retention portion 112.

In the present embodiment, the first abutment portion 111 of the engagement element 110 protrudes from and extends in a direction of outwardly away from the outer surface 134 of the housing 130.

As will be understood, the first abutment portion 111 in the present embodiment, may further prevent ingress of water from the outer surface 134 of the housing 130 external of the surface 134 of the housing 130 into the switch via the aperture 132, due to it extending outward from the surface. Furthermore, the first abutment portion 111 may further extend in a direction away from the aperture so as to form a rebate between the outer surface of the housing of the electrical switch and the first abutment portion 111, so as to further prevent ingress of water from the surface 134 of the housing 130 external of the surface 134 of the housing 130 into the switch via the aperture 132.

The sealing element 120, being slidingly engageable with the engagement element 110, is retained by the retention portion 112 of the engagement element 110. Said sealing element 120 including a first complementary abutment portion 122 for sliding engagement with the first abutment portion 111 of the engagement element 110. In the present embodiment, the first complementary abutment portion 122 is provided by the central underside surface of the sealing element 120.

In the present embodiment, the retention portion 112 of the engagement element 110 is provided as a rail assembly which protrudes from the outer surface 134 of the housing 130, and extends in a direction of outwardly away from the outer surface 134 of the housing 130.

As is depicted, the rail assembly is provided by a pair of elongate rail members, each of which is disposed on the outer surface 134 of the housing 130 and extend in the direction of movement 136 on opposed sides of the aperture 132.

Also as depicted, each rail member includes an elongate protrusion extending along the length of each rail, whereby each elongate protrusion extends in a direction of away from the aperture 132 of the housing 130, so as to form a retention rebate 138 between each rail and the outer surface 134 of the housing 130. The sealing element 120 includes a pair of complementary protrusions 124 each of which extends within the rebate 138 of each rail member such that the sealing element 120 is retained to the retention portion 112 of the engagement element 110.

As will be understood, the retention portion 112 of the present embodiment may further prevent ingress of water from the outer surface 134 of the housing 130 external of the surface 134 of the housing 130 into the switch via the aperture 132, due to it extending outward from the surface.

Furthermore, the retention rebate 138 may further prevent ingress of water from the surface 134 of the housing 130 external of the surface 134 of the housing 130 into the switch via the aperture 132.

The sealing element 120 is formed from an elastically resilient polymeric material such that when it is retained by the engagement element 110, sealing engagement is provided between the first complementary abutment portion 122 of the sealing element 120 and the engagement element 110.

The sealing engagement of the sealing element 120 against the first abutment portion 111 is caused by the sealing element 120 being urged against the first abutment portion 111 due to the elastically resilient properties of the polymeric material from which the sealing element 120 is formed.

The sealing engagement occludes and prevents the passage and ingress of the particulates, dust and water from external of the first abutment portion 111 into the aperture 132, thus keeping particulates, dust and water out of the switch.

The sealing element 120 is suitably sized and is formed from an elastically resilient polymeric material including those selected from the group including a urethane such as thermoplastic polyurethane, synthetic rubber, silicone, a silicone rubber or the like, so as to maintain the sealing engagement.

In the present embodiment, the sealing element 120 includes a further complementary abutment portion 125 for sliding engagement with a further abutment portion of the engagement element 111 which is provided by the outer surface 134 of the housing 130. Again, retention of the sealing element 120 by the engagement element 110 causes sealing engagement between the further complementary abutment portion 125 of the sealing element 120 and the further abutment portion of the engagement element 111, so as to occlude passage and ingress of particulates, dust and water from external of the further abutment portion of the engagement element 111 to the aperture 132 extending through the outer surface 134 of a housing 130 of the electrical switch. The sealing element 120 is suitably sized and is formed so as to provide sealing engagement, and not cause excessive resistive force to movement of the sealing element 120 when a switch embodying the sealing system is deployed in a hand-held electrical device.

As shown in FIGS. 1*e*, 1*f*, 2*a*, 2*b* and 2*c*, when the sealing member 120 is at extremities of movement in conjunction with movement of the actuator 140 of the electrical switch, the sealing engagement between the first complementary abutment portion 122 of the sealing element 120 and the first abutment surface 111 of the engagement element 110 is maintained.

The first abutment surface 111 of the engagement element 110 is sized such that in addition to the sealing engagement being formed in conjunction with elastically resilient properties of the polymeric material from which the sealing element 120 and being maintained during movement of the sealing element 120 and at the extremities of movement, the resistive force required to be overcome so as to move the sealing element 120 by a user is sufficiently low so as not to impede movement of the actuator during activation and deactivation of the switch when embodied in a hand operable electrical device.

This is achieved by having a relatively low contact area between the first abutment surface 111 with the complementary abutment portion 122 which is provided by the central underside surface of the sealing element 120. Further, other resistive forces to movement of the sealing element 120 such as between the sealing element and the rigid retention portion 112 provided by the pair of rails in the present embodiment, are sufficiently low so as not to impede movement of the actuator during activation and deactivation of the switch.

Within the present embodiment, the actuator 140 of the switch is operable by urging which extends through the aperture 132, in the linear direction of movement 136 by a user. In other embodiment, as will be appreciated, an actuation portion may extend through the aperture 132 which is in operable communication with the actuator, such that the movement is achieved by urging the actuation portion.

In the present embodiment, the actuator 140 extends through the sealing element 120 and the sealing element 120 is sealing engaged and affixed to the actuator 140 so as to occlude passage and ingress of particulates and water from external of the housing 130 of the switch through the outer surface 134 of a housing of the electrical switch, and urging of the actuator 140 urges the sealing element 120 in the direction of movement 140. Alternatively, urging of the sealing element 120 in the direction of movement 136 may urge the actuator in the direction of movement 136.

In other or alternate embodiments, the sealing element 120 may extend over the actuator 140 or actuation portion, such that the actuator 140 or actuation portion is encapsulated between the sealing element and internal of the housing 130. Upon urging the actuator 140 or actuation portion by through the sealing element 120, the actuator 140 urged in the direction of movement 136 and the sealing element 120 is urged in the direction of movement 136 by the actuator 140 or the actuation portion. Alternatively, urging of the sealing element 120 in the direction of movement 136 urges the actuator 140 in the direction of movement 136.

In the present embodiment, the engagement element 110 is integrally formed with a housing 130 of an electrical switch. As will be understood, in other or alternate embodiment, the engagement element 110 may be affixable to a housing of an electrical switch by snap-fit, ultrasonic welding, adhesive, rivet or the like.

Figure 3:
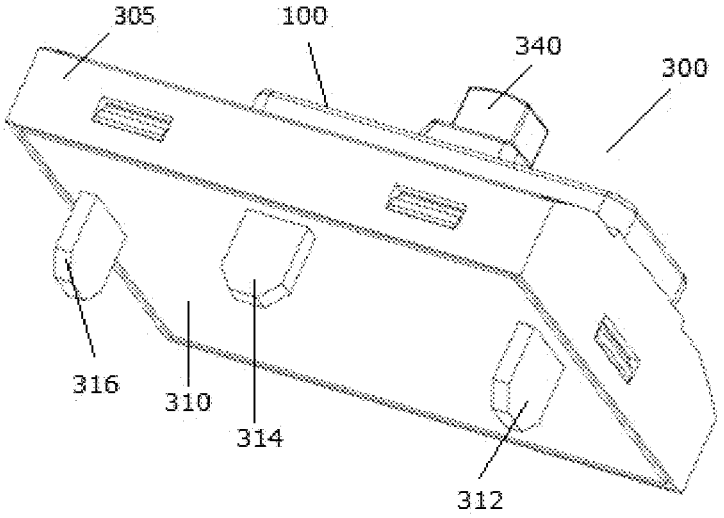
FIG. 3 depicts a perspective view of an example of an electrical switch in conjunction with the sealing assembly as depicted in FIGS. 1*a* to 2*c;*

Referring to FIG. 3, by way of an exemplary embodiment, there is shown an example of an electrical switch 300 according to the present invention in conjunction with the sealing assembly 100 as depicted in FIGS. 1*a* to 2*c*. Although depicted as being used in conjunction with a switch of the present invention, as will be understood by those skilled in the art, the sealing assembly of the present invention may be utilised with numerous types of switches, and afford such switches the advantages of the sealing assembly 100.

In the present example, the switch 300 includes an upper housing 305, a lower housing 310, an actuator 340 operably coupled with an actuation assembly deployed within the housing of the switch 300. Three terminals are provided, a first terminal 312, a second terminal 314, and a third terminal 316.

The switch 300 as shown is a three position, single pole switch, with an OFF position as a center position, and operable to provide electrical connectivity between the first terminal 312 with the second terminal 314 when in a first end position, and operable to provide electrical connectivity between the third terminal 316 with the second terminal 314 when in a second end position. Such a switch may be used in conjunction with hand operable devices, such as power tools, whereby the switch is wired so as to provide for example forward and reverse motion activation, with an off position therebetween.

Within the art within a switch or switch assembly, a spring or biasing means is utilised in order to urge contacts together so as to provide for electrical current flow therebetween. Further and within the art, such a spring or biasing means also holds or secures the actuator assembly of a switch in an operable position, such as a connect or non-connect between the contacts of the switch typically by way of a mechanical locking or securement mechanism such a as a detent arrangement, whereby the spring or biasing means causes such a locking effect.

In order to move an actuator assembly of a switch so as to be able to select different operable positions to provide different operating conditions, it is required that a user apply an actuation force, such as urging an actuator in a linear direction of movement so as to alter the operable conditions of for example a hand-held or portable device, so that a user overcomes the effect of the spring or biasing means. Further, depending upon the locking effect, a requisite force or force profile may be required to also move the actuator assembly into an adjacent operable position, not only to release the actuator assembly from an adjacent operable position.

The force required to overcome the locking mechanism and the force profile throughout movement of the actuator assembly, in particular for hand operable electrical devices, must be appropriate that a user can, in many cases, single handedly overcome such locking, and that the force required is not too great. Further, the force required to overcome such locking must not be too low such that the actuator assembly may be inadvertently moved by accidental contact with a user's hand or with an object. Still further, the force profile for user input and movement of the actuator assembly must not permit the actuator assembly to move to non-desired operable positions.

Accordingly, the spring or biasing means and mechanical arrangement determines both the contact pressure between contacts as well as the force required to overcome the locking effect at operable positions of a switch. As such, when a user urges an actuator assembly between operable positions, the contact stress between electrical contacts varies due to the user input of force required to effect movement.

It has been found that longevity of a switch can be reduced by inappropriate or variation of contact pressure between electrical contacts. For example, it has been found that should contact stresses between electrical contacts be too low that the endurance or effective life of a switch can be reduced. Further, should contact stresses be too great, wear of contacts can be exacerbated, again reducing the endurance or effective life of a switch.

For hand operable devices such as power tools and personal care devices, switches may not typically be serviceable items at least on site, and failure of a switch causes interruption of work whilst repair is effected or an alternate device in the case of hand tools, causing economic loss. In the case of personal care devices, failure of a switch may render the device non-repairable, and cause a user to dispose of and replace an otherwise satisfactorily performing device, resulting in negative environmental waste and economic loss effects.

As such, whenever the position of a switch is altered by a user, either deliberately or accidentally, and the actuator assembly moved and electrical contacts are brought into contact or contact is broken, the contact force between electrical contacts is varied, with either or both excessive or low contract pressures, due to the user being required to overcome the mechanical lock which maintained the actuator assembly at operable position or the force required to move the actuator assembly into another operable position, thus reducing the serviceable life of the switch due to at least progressive and cumulative damage to the electrical contacts.

The present inventor has identified the shortcomings switches as in the existing art, and provided a solution which ameliorates or reduces such shortcomings which adversely affect the longevity and serviceable life of a switch.

The present inventor has provided a solution by providing two independent biasing assemblies in which:

(i) a first biasing assembly maintains the contact pressure between electrical contacts during movement of an actuation assembly within a predetermined range; and (ii) a second biasing assembly which provides the locking effect so as to retain the actuation assembly.

By providing two such independent biasing assemblies, the present invention provides the following advantages:

(a) increased longevity and service life of a switch due to overcoming the adverse effects of both low and high contact stresses between electrical contacts by having a biasing assembly independent of the locking mechanism and physical effects upon movement of the actuation assembly; and (b) a locking mechanism which may be designed for requisite user load input profiles for movement and retention of the actuation assembly, whereby movement or user input in order to overcome locking forces to move the actuation assembly to alternate operable positions so that contact loads between electrical contacts are maintained within an acceptable operational range.

Accordingly, the present invention provides a switch with both increased longevity, as well as ease of design of operable position selection so as to accommodate requisite design and operational requirements as identified above.

Figure 4A:
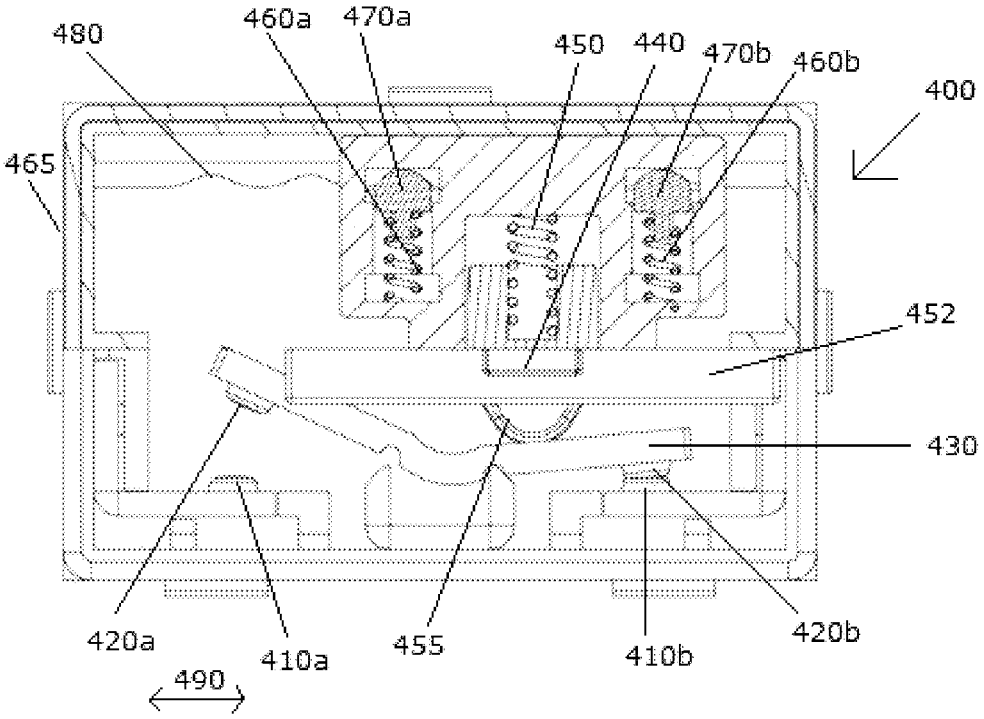
FIG. 4*a* depicts a cross sectional view of a first example of an electrical switch in accordance with the present invention in a first configuration.
Figure 4B:
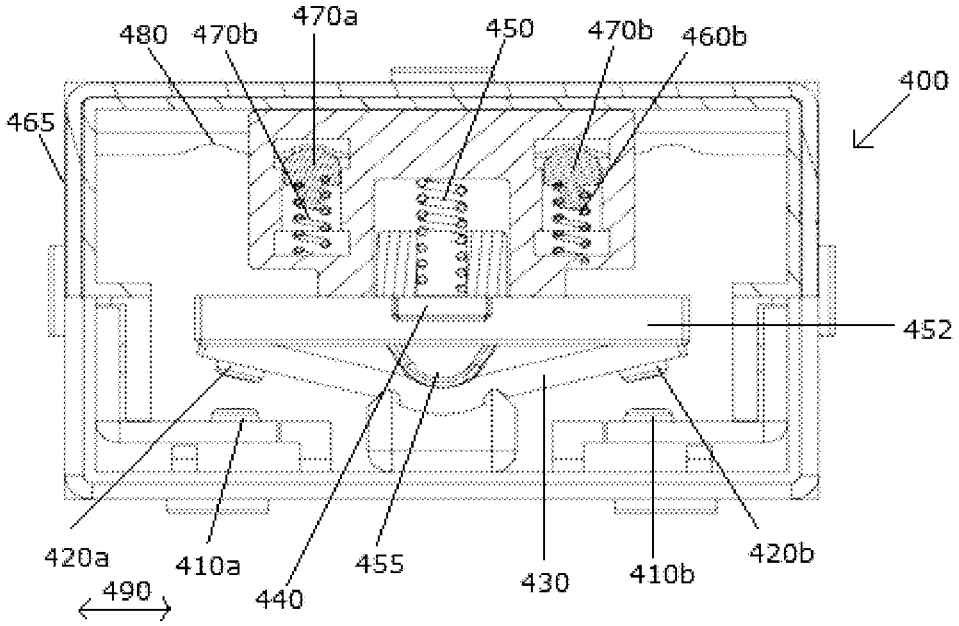
FIG. 4*b* depicts a cross sectional view of the example of an electrical switch of FIG. 4*a* in a second configuration.
Figure 4C:
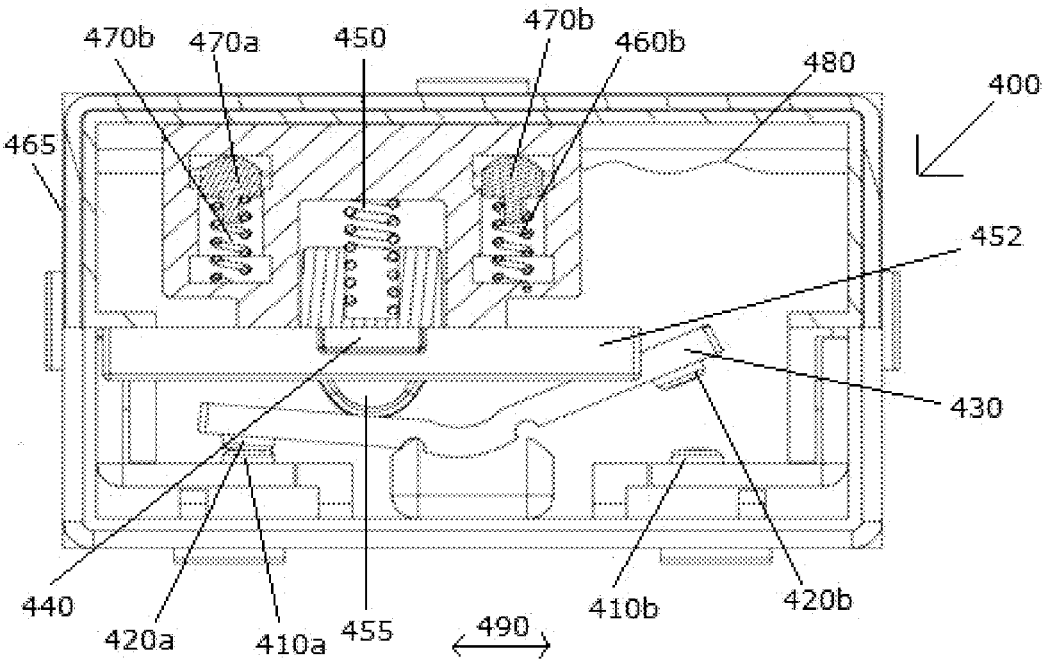
FIG. 4*c* depicts a cross sectional view of the example of an electrical switch of FIG. 4*a* and FIG. 4*b* in a third configuration.

Referring to FIGS. 4*a*, 4*b* and 4*c*, there is shown a sectional view of a first example of an electrical switch 400 in accordance with the present invention.

The switch 400 is linear actuatable by a user by input of force so as to move the actuator assembly 452 retained in a housing 465 by way of an actuator 440 operable external of the housing 465 in a direction of linear movement 490. In the present example, the switch has three operable positions, with electrical contact being provided between stationary contact 410*b* and movable contact 420*b* in FIG. 4*a*, no electrical contact being provided in FIG. 4*b*, and electrical contact being provided between stationary contact 410*a* and movable contact 420*a* in FIG. 4*c*.

Referring to FIG. 4*a*, a contact biasing assembly is provided by compression spring 450 and bullet 455, which urge against lever 430 which carries moveable contacts 420*a* and 420*b* thereon, which subsequently urge contacts 410*b* and 420*b* together so as to provide electrical communication therebetween.

A locking assembly is provided by a pair of detent arrangements comprising compression spring 460*a* and bullet 470*a* and compression spring 460*b* and bullet 470*b* each of which is equidistantly disposed about the biasing assembly, and a recess element 480 having a plurality of recesses extending there along in which the bullets 470*a* and 470*b* are urged and retained by the compression springs 460*a* and 460*b* and defining a plurality of operable positions of the switch 400.

The actuator assembly 452 is retained within the housing 465 so that movement in directions other than the direction of movement 490 is impeded. Accordingly, the forces applied to the lever 430 by the contact biasing assembly and locking assembly are independent of each other.

The forces which are required to be overcome by a user as provided by the detent arrangement of the locking assembly in order to move the actuator assembly 452 by user so as to be in the operable position as shown in FIG. 4*b* are independent of the force applied by the contact biasing assembly.

Accordingly, the contact biasing assembly may be arranged so as to provide requisite loading and pressure between the contacts to increase longevity and service life of the switch, independently of the locking assembly.

Further, the force and movement profile of the locking assembly and characteristics thereof may be designed or selected for requisite operational requirements depending upon the application of the switch 400, such as are discussed above.

When the actuator assembly 452 is in the operational position as shown in FIG. 4*b*, in the present example there is no contact between contacts 410*a* and 420*a*, and no contact between contacts 410*b* and 420*b* and as such, the switch may be considered in an OFF position.

When the actuator assembly 452 is located in the operational position as shown in FIG. 4*b*, in the present example there is no contact between contacts 410*a* and 420*a*, and no contact between contacts 410*b* and 420*b* and as such, the switch may be considered in an OFF position.

When the actuator assembly 452 is located in the operational position as shown in FIG. 4*c*, electrical contact is provided between contacts 410*a* and 420*b*.

Within the current exemplary embodiment, the lever 430 carries electrical current and is in electrical communication with a terminal of the switch 400 and the stationary contacts 410*a* and 410*b* are in electrical communication with other respective terminals.

When the switch is in the operable position as shown in FIG. 4*a* electrical connection is effected between the terminal in communication with stationary contact 410*b* and the terminal in electrical communication with lever 430, when the switch is in the operable position as shown in FIG. 4*c* electrical connection is effected between the terminal in communication with stationary contact 410*b* and the terminal in electrical communication with lever 430, and when the switch is in the operable position as shown in FIG. 4*b* there is no electrical communication between the terminals.

Accordingly, the present exemplary embodiment may be considered a center-OFF type switch. Such switches may be deployed in applications whereby it is undesirable to move from the electrical contact position as shown in FIG. 4*a* directly to that as shown in FIG. 4*c*, and a center-OFF arrangement as depicted can reduce such inadvertent switching.

Further, as the present invention provides for force and movement of the actuator assembly 452 profile determination and design, independent of the contact force as provided by the contact biasing assembly, resistance to inadvertent movement can be readily implemented by design of the locking assembly and the forces to overcome movement of the actuator in particular directions of movement 490.

For example, in a hand operable power tool, such as an electric screwdriver, such a switch may be used so as to provide operability of forward and reverse which may correspond to the configurations of FIG. 4*a* and FIG. 4*c*, with an off position defined by the configuration of FIG. 4*b*.

In such an example, an electric screwdriver may have an operational voltage of 3.6V and an operational current of 10 A and as such, first constant pressure as provided by the contact biasing assembly of the present invention increases longevity and service life of such a switch.

Furthermore, such an electric screwdriver may have a start-up current of 28 A due to the torque required and as such, inadvertent switching of the screwdriver from one direction to the other direction of rotation has several disadvantages and drawbacks including:

(i) reducing service life of the switch by frequent large currents;

(ii) use risks of inadvertently loosening or tightening of a fastener or the like; and (iii) unexpected change in direction of such a device, may result in burring and damage to a head of a fastener, which may have significant disadvantage such as difficulty of removal of the fastener or difficulty further tightening.

The present invention, by providing a locking mechanism which is independent of the contact biasing assembly, allows for disadvantages including those as recited above, to be reduced or overcome, by providing independent design freedom of the movement profile of the actuator assembly.

Figure 5A:
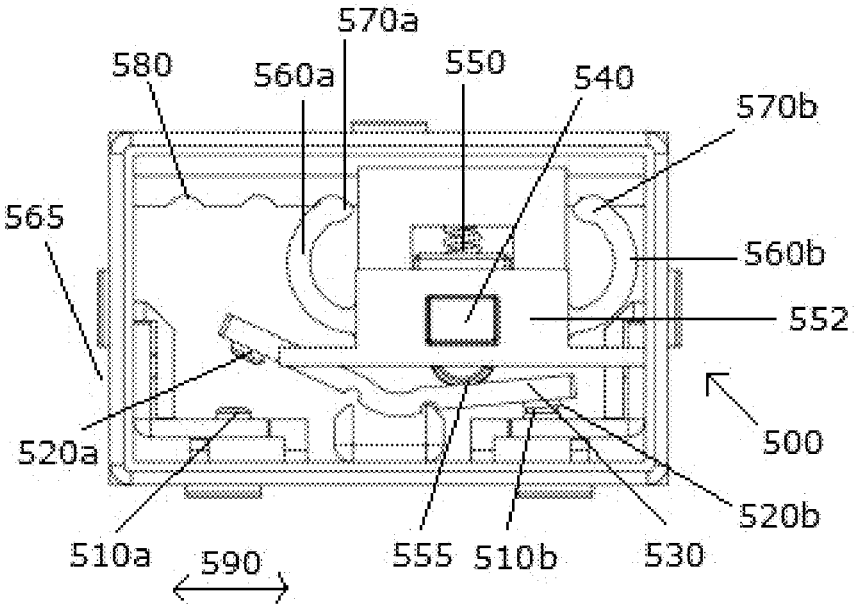
FIG. 5*a* depicts a cross sectional view of a second example of an electrical switch in accordance with the present invention in a first configuration.
Figure 5B:
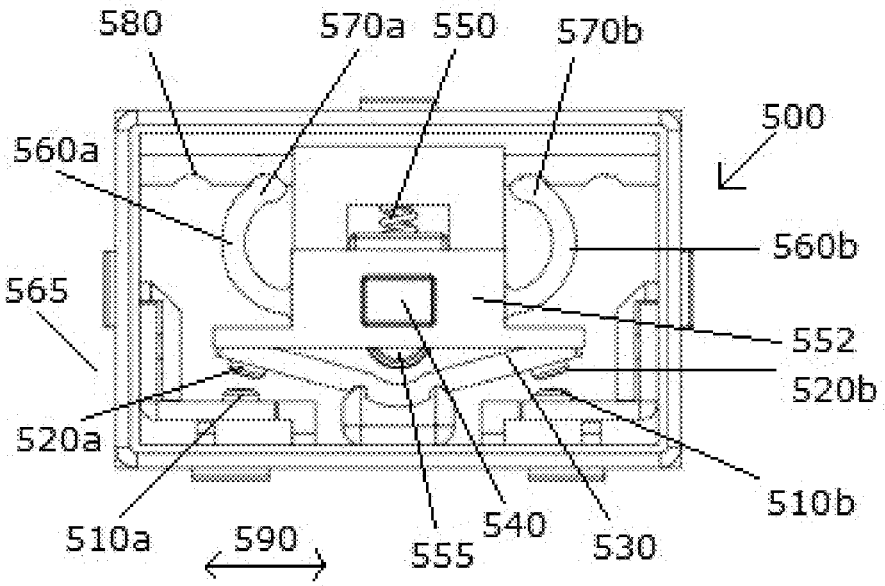
FIG. 5*b* depicts a cross sectional view of the example of an electrical switch of FIG. 5*a* in a second configuration.
Figure 5C:
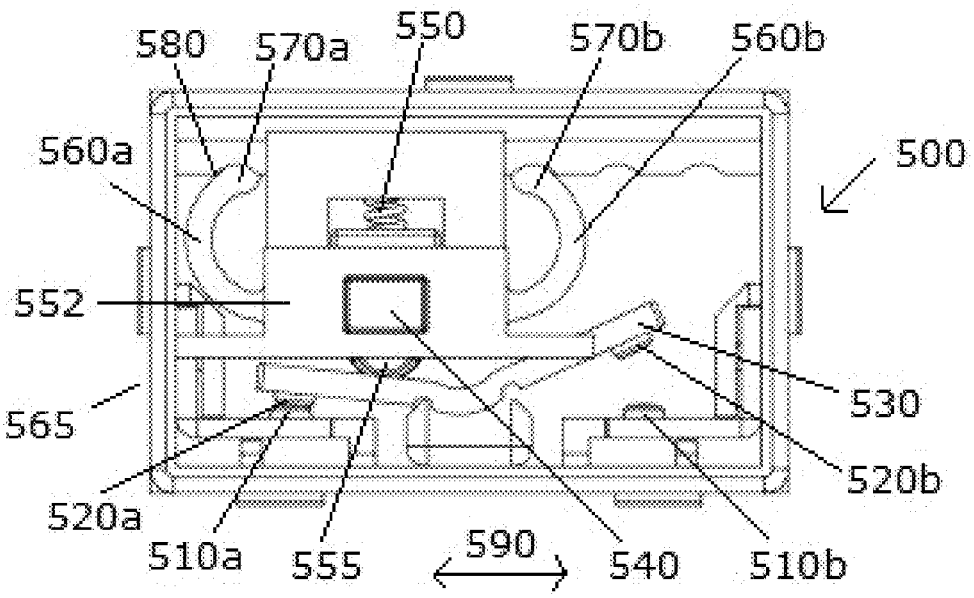
FIG. 5*c* depicts a cross sectional view of the example of an electrical switch of FIG. 5*a* and FIG. 5*b* in a third configuration.

Referring to FIGS. 5*a*, 5*b* and 5*c*, there is shown a sectional view of a second example of an electrical switch 500 in accordance with the present invention.

Similarly to the example of FIGS. 4*a*, 4*b* and 4*c*, the switch 500 of the present example is linear actuatable by user by input of force so as to move the actuator assembly 552 retained in a housing 565 by way of an actuator 540 operable external of the housing 565 in a direction of linear movement 590. In the present example, the switch has three operable positions, with electrical contact being provided between stationary contact 510*b* and movable contact 520*b* in FIG. 5*a*, no electrical contact being provided FIG. 5*b*, and electrical contact being provided between stationary contact 510*a* and movable contact 520*a* in FIG. 5*c*.

Referring to FIG. 5*a*, a contact biasing assembly is provided by compression spring 550 and bullet 555, which urge against lever 530 which carries moveable contacts 520*a* and 520*b* thereon, which subsequently urge contacts 510*b* and 520*b* together so as to provide electrical communication therebetween.

In the present example, a locking assembly is provided by a pair of detent arrangements comprising biasing arm 560*a* having a bullet portion 570*a* and biasing arm 560*b* having a bullet portion 570*b* each of which is equidistantly disposed about the biasing assembly, and a recess element 580 having a plurality of recesses extending there along in which the bullet portions 570*a* and 570*b* are urged and retained by the biasing arms 560*a* and 560*b* and defining a plurality of operable positions of the switch 500. The biasing arms 560*a* and 560*b* are preferably formed from a polymeric material, and can be formed integrally with the actuator assembly 552.

The biasing assembly of the present invention, due to the elastic resilience of the biasing arms, provides a "snap action" as the bullet portions 570*a* and 570*b* locate within the recess element, and provides positive retention as the biasing arm 560*a* and 560*b* urge and accelerate the bullet portions 570*a* and 570*b* into recesses in recess element 580.

The locking assembly of the present example provides several advantages, including:

(i) ease of assembly due to reduction in components;

(ii) reduction in assembly costs due to obviation of the necessity to assemble a spring and ball detent arrangement;

(iii) reduction in manufacturing costs due to obviation of spring and bullet detent componentry;

(iv) ease of manufacture by incorporation of biasing arms with actuator assembly, which may be formed integrally when formed from a polymeric material such as a nylon polymer; and (v) design flexibility, permitting design of requisite force and movement profiles, by being independent from the contract biasing assembly, similarly as described above.

The actuator assembly 552 is retained within the housing 565 so that movement in directions other than the direction of movement 590 is impeded. Accordingly, the forces applied to the lever 530 by the contact biasing assembly and locking assembly are independent of each other.

The forces which are required to be overcome by a user as provided by the detent arrangement of the locking assembly in order to move the actuator assembly 552 by user so as to be in the operable position as shown in FIG. 5*b* are independent of the force applied by the contact biasing assembly.

Similarly as described in reference to the first example of FIGS. 4*a*, 4*b* and 4*c*, the contact biasing assembly may be arranged so as to provide requisite loading and pressure between the contacts to increase longevity and service life of the switch, independently of the locking assembly.

Again, the force and movement profile of the locking assembly and characteristics thereof may be designed or selected for requisite operational requirements depending upon the application of the switch 500, such as are discussed above.

Similarly as described in reference to the first example of FIGS. 4*a*, 4*b* and 4*c*, when the actuator assembly 552 is in the operational position as shown in FIG. 5*b*, in the present example there is no contact between contacts 510*a* and 520*a*, and no contact between contacts 510*b* and 520*b* and as such, the switch may be considered in an OFF position.

When the actuator assembly 552 is located in the operational position as shown in FIG. 5*b*, in the present example there is no contact between contacts 510*a* and 520*a*, and no contact between contacts 510*b* and 520*b* and as such, the switch may be considered in an OFF position.

When the actuator assembly 552 is located in the operational position as shown in FIG. 5*c*, electrical contact is provided between contacts 510*a* and 520*a*.

Within the current exemplary embodiment, the lever 530 carries electrical current and is in electrical communication with a terminal of the switch 500 and the stationary contacts 510*a* and 510*b* are in electrical communication with other respective terminals.

When the switch is in the operable position as shown in FIG. 5*a* electrical connection is effected between the terminal in communication with stationary contact 510*b* and the terminal in electrical communication with lever 530, when the switch is in the operable position as shown in FIG. 5*c* electrical connection is effected between the terminal in communication with stationary contact 510*a* and the terminal in electrical communication with lever 530, and when the switch is in the operable position as shown in FIG. 5*b* there is no electrical communication between the terminals.

Accordingly, the present exemplary embodiment may be considered a center-OFF type switch. Such switches may be deployed in applications whereby it is undesirable to move from the electrical contact position as shown in FIG. 5*a* directly to that as shown in FIG. 5*c*, and a center-OFF arrangement as depicted can reduce such inadvertent switching.

Whilst the above two examples incorporate structurally varying arrangements for the biasing arrangement, both provide the above recited advantages as provided by the present invention.

Figure 6A:
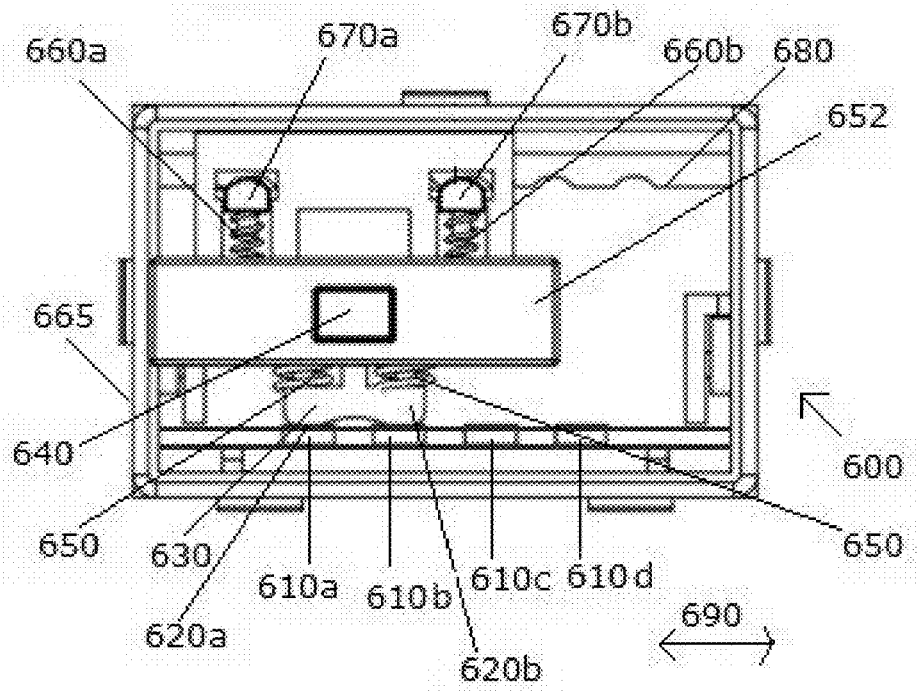
FIG. 6*a* depicts a cross sectional view of a third example of an electrical switch in accordance with the present invention in a first configuration.
Figure 6B:
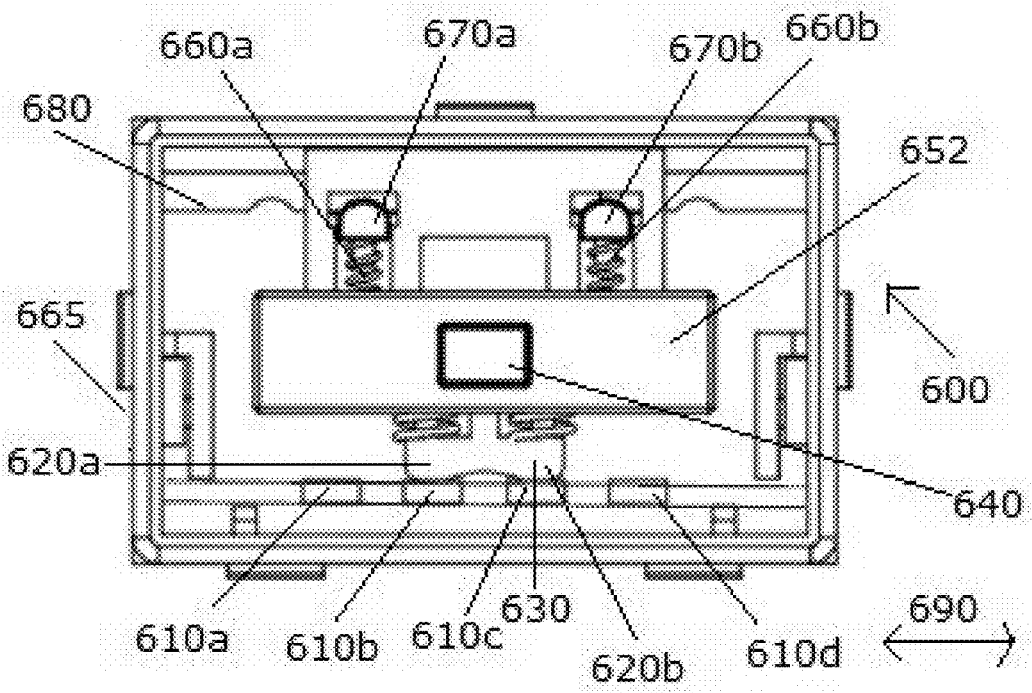
FIG. 6*b* depicts a cross sectional view of the example of an electrical switch of FIG. 6*a* in a second configuration.
Figure 6C:
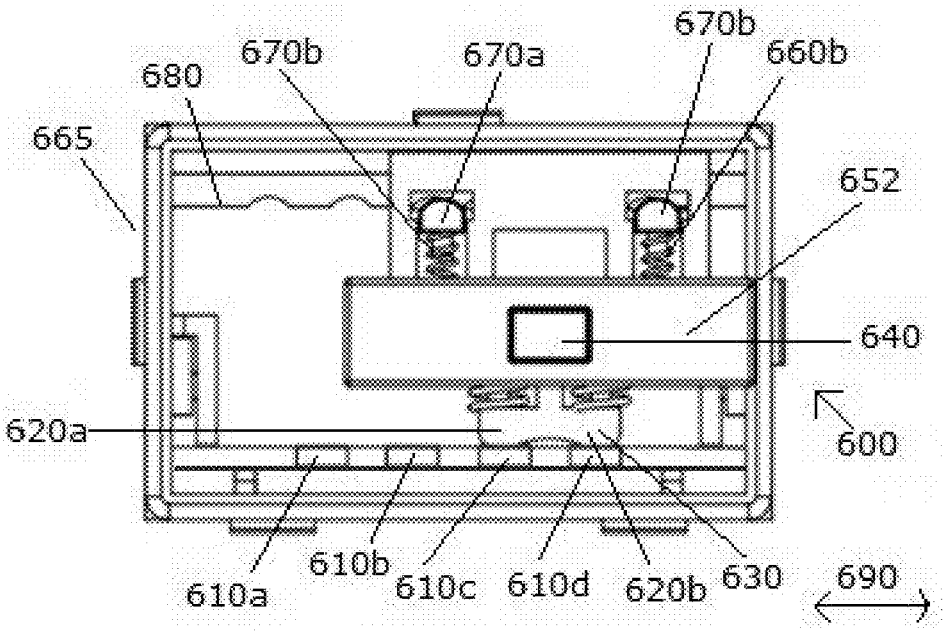
FIG. 6*c* depicts a cross sectional view of the example of an electrical switch of FIG. 6*a* and FIG. 6*b* in a third configuration.

Referring to FIGS. 6*a*, 6*b* and 6*c*, there is shown a sectional view of a third example of an electrical switch 600 in accordance with the present invention.

Similarly as described with reference to the first example as described with reference to FIGS. 4*a*, 4*b* and 4*c* and the second example as described with reference to FIGS. 5*a*, 5*b* and 5*c*, the switch 600 of the present example is linear actuatable by user by input of force so as to move the actuator assembly 652 retained in a housing 665 by way of an actuator 640 operable external of the housing 665 in a direction of linear movement 690.

In the present example, the switch has three operable positions, as shown in FIGS. 6*a*, 6*b* and 6*c*. Similarly as described in relation to the first and second examples, in accordance with the present invention, the contact biasing assembly and the locking assembly are provided so as to be independent and provide the above recited advantages.

Referring to FIG. 6*a*, a contact biasing assembly is provided by compression springs 650, which urge against conduction element 630 which carries or includes integrally formed moveable contacts 620*a* and 620*b* thereon, which subsequently urges moveable contact 620*a* against stationary contact 610*a* and urges move-able contact 620*b* against stationary contact 610*b*, so as to provide electrical communication therebetween terminals which are in electrical communication with stationary contact 610*a* and stationary contact 610*b*, whereby electrical current passes through conduction element 630.

Similarly as described with reference to the example of FIGS. 4*a*, 4*b* and 4*c*, a locking assembly is provided by a pair of detent arrangements comprising compression spring 660*a* and bullet 670*a* and compression spring 660*b* and bullet 670*b* each of which is equidistantly disposed about the biasing assembly, and a recess element 680 having a plurality of recesses extending there along in which the bullets 670*a* and 670*b* are urged and retained by the compression springs 660*a* and 660*b* and defining a plurality of operable positions of the switch 600.

As will be appreciated, the locking assembly as described with reference to FIGS. 5*a*, 5*b* and 5*c*, other independent locking assemblies could also be implemented within the present example.

The actuator assembly 652 is retained within the housing 665 so that movement in directions other than the direction of movement 690 is impeded. Accordingly, the forces applied to the lever conduction element 630 by the contact biasing assembly and locking assembly are independent of each other.

The forces which are required to be overcome by a user as provided by the detent arrangement of the locking assembly in order to move the actuator assembly 652 by user so as to be in the operable position as shown in FIG. 6*b* are independent of the force applied by the contact biasing assembly. Accordingly, the contact biasing assembly may be arranged so as to provide requisite loading and pressure between the contacts to increase longevity and service life of the switch, independently of the locking assembly.

Further, the force and movement profile of the locking assembly and characteristics thereof may be designed or selected for requisite operational requirements depending upon the application of the switch 600, such as are discussed above.

When the actuator assembly 652 is in the operational position as shown in FIG. 6*b*, in the present example, moveable contact 620*a* is urged against stationary contact 610*b*, and moveable contact 620*b* is urged against stationary contact 610*c*, so as to provide electrical communication therebetween terminals which are in electrical communication with stationary contact 610*a* and stationary contact 610*b*, whereby electrical current passes through conduction element 630.

When the actuator assembly 652 is located in the operational position as shown in FIG. 6*c*, moveable contact 620*a* is urged against stationary contact 610*c*, and moveable contact 620*b* is urged against stationary contact 610*d*, so as to provide electrical communication therebetween terminals which are in electrical communication with stationary contact 610*a* and stationary contact 610*b*, whereby electrical current passes through conduction element 630.

As will be understood, the present example of switch 600 can be configured so as to be center-OFF and have two differ ON positions similarly to switch 400 and switch 500 above, by connecting stationary contacts 610*b* and 610*c* electrically together so as to effectively be a common terminal, and whereby stationary contacts 610*a* and 610*d* are each independently in electrical communication with two other terminals.

Again, as the present invention provides for force and movement of the actuator assembly 630 profile determination and design, independent of the contact force as provided by the contact biasing assembly, resistance to inadvertent movement can be readily implemented by design of the locking assembly and the forces to overcome movement of the actuator in particular directions of movement 690.

The above described embodiments of the invention of FIGS. 4*a*, 4*b* and 4*c*, FIGS. 5*a*, 5*b* and 5*c* and FIGS. 6*a*, 6*b* and 6*c*, by having side located contacts, allows for the provision of a switch which has a planar profile with the actuator extending through an elongate slotted aperture so as to allow the switch to operable by a user by way of an external sliding action.

As such, these embodiments allow the provision of a switch which has a low profile yet has sufficient current capacity and rating, for applications such as in hand help power tool, for example electric screwdrivers, which have design constraints and characteristics including:

(i) minimal internal space for implementation; and (ii) high current ratings during operation, for example 10A, and peak currents up to 28 A or 30 A during start-up.

Accordingly, it is required that a switch for such a device must meet small physical permissible space constraints, as well as have sufficient current rating.

As such, the switch as shown and described with reference to above embodiments in FIGS. 4*a*, 4*b* and 4*c*, FIGS. 5*a*, 5*b* and 5*c* and FIGS. 6*a*, 6*b* and 6*c*, by implementing a planar arrangement as shown, has been demonstrated to meet such stringent physical size requirement, whilst also meeting the requisite electrical performance requirement. The present invention has been found to be able to be realized having a height of as low as 4 mm, which permits use in commercial applications such as electric screwdrivers.

Although the switch of the present invention has been described and depicted as having side contacts and a planar arrangement, in other or alternate embodiments the actuator assembly may be operable from a position above the contacts as opposed to normal to the contacts as shown, when such a planar arrangement may not necessarily be required.

Further, in other or alternate embodiments of the switch of the present invention, the actuator may extend in the direction of movement of the actuator assembly, and actuation be effected by a push or pull type motion, and could extend from one or both ends of a housing of such a switch.

Still further, in the embodiments of the switch of the present invention as described and depicted in the drawings, the locking assembly has been depicted as a pair of equally spaced apart detent assemblies about the contact biasing assembly. However, in other or alternate embodiments, the locking assembly may be provided by other mechanical arrangements, and the examples as provided do not import any structural limitations.

Further still, in the embodiments as described and depicted, the switch of the present invention, the switch is shown as a single-pole three-position switch, with a center-OFF position. However in other or alternate embodiments, the number of poles may be greater than one, and the switch may have two or more positions, and may have an OFF position at different operable positions or may not necessarily have an OFF position depending upon the requisite application.

In embodiments of the present invention, a switch according to the present invention by way of example those as described with reference to FIGS. 4*a*, 4*b* and 4*c*, FIGS. 5*a*, 5*b* and 5*c* and FIGS. 6*a*, 6*b* and 6*c*, may be utilised in conjunction with the sealing assembly as described in reference to FIGS. 1*a* to 2*c*, such as in FIG. 3 as described above.

In such an embodiment, by provision of a low profile and planar switch in conjunction with a substantially planar and sealing element of the sealing assembly, a switch meeting the design and parameter requirements of hand operable power tools such as an electric screwdriver as described above can be provided, which also meets requisite design requirement including prevention of ingress of dust and water into the switch.

Further, in view of the design freedom provided in relation to the load and movement characteristics of the locking mechanism which is independent of the contact biasing assembly, for embodiments of a switch which include a sealing assembly of the present invention, by use of design parameter it may be configured such that the force required a user to urge the actuator assembly may be greater than the frictional forces required to be overcome in order to move the sealing element in the direction of movement. Accordingly, upon a user moving the switch between operable positions, no drag effect caused by the sealing element would be felt or noticed by the user. Further, the force required to overcome friction for movement of the sealing member would not impact up the requisite force and movement profile as provided by the locking mechanism.

It will be apparent from the preceding embodiments that various advantages may be provided by embodiments of the present invention over existing technologies including those as recited above.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A sealing assembly for prevention of ingress of particulates and water into an electrical switch having two or more positions moveable between a first extremity and a second extremity in a linear direction of movement by an actuator, whereby said actuator is operable through an aperture extending through an outer surface of a housing of the electrical switch, said sealing assembly comprising:

an engagement element including a rigid first abutment portion for circumscribing the aperture extending through the outer surface of the housing of the electrical switch and a rigid first retention portion;

a sealing element being slidingly engageable with the engagement element in a direction of said linear direction of movement of the actuator and being retained by the retention portion of the engagement element, said sealing element including a first complementary abutment portion for sliding engagement with the first abutment portion of the engagement element;

wherein the sealing element is formed from an elastically resilient polymeric material such that when retained by the engagement element, sealing engagement between the first complementary abutment portion of the sealing element and the first abutment portion is effected as the first complementary abutment portion is urged against a first abutment surface of the engagement element so as to occlude passage and ingress of particulates and water from external of the first abutment portion to the aperture extending through the outer surface of a housing of the electrical switch;

wherein upon movement of the sealing element in conjunction with movement of the actuator of the electrical switch between the first extremity and the second extremity, said sealing engagement between the first complementary abutment portion of the sealing element and the first abutment surface of the engagement element is maintained;

wherein the retention portion of the engagement element is provided as a rail assembly which protrudes from and extends in a direction outwardly away from the outer surface of the housing, and wherein the rail assembly is provided by a pair of elongate rail members, wherein each rail member is of elongate form and is disposed on the outer surface of a housing of the electrical switch and extend in the direction of said linear direction of movement on opposed sides of the aperture.

2. A sealing assembly according to claim 1, wherein the first abutment portion of the engagement element protrudes from and extends in a direction outwardly away from the outer surface of the housing.

3. A sealing assembly according to claim 2, wherein the first abutment portion further prevents ingress of water from external of the surface of the housing into the electrical switch via the aperture.

4. A sealing assembly according to claim 3, wherein the first abutment portion further extends in a direction away from the aperture so as to form a rebate between the outer surface of the housing of the electrical switch and the first abutment portion, to further prevent ingress of water from external of the surface of the housing into the electrical switch via the aperture.

5. A sealing assembly according to claim 1, wherein the retention portion prevents ingress of water from external of the surface of the housing into the electrical switch via the aperture.

6. A sealing assembly according to claim 1, wherein each rail member includes an elongate protrusion extending along at least a portion of the length of each rail, wherein each elongate protrusion extends in a direction away from the aperture of the housing such that a retention rebate is formed between each rail and the outer surface of the housing; and wherein the sealing element includes a pair of complementary protrusions each of which extends within the retention rebate of each rail member such that the sealing element is retained to the retention portion of the engagement element.

7. A sealing assembly according to claim 6, wherein the retention rebates prevent ingress of water from external of the surface of the housing into the electrical switch via the aperture.

8. A sealing assembly according to claim 7, wherein the further abutment surface is provided by the outer surface of the housing of the electrical switch, and a further complementary abutment surface is a protrusion extending from the sealing element in a direction of towards the outer surface of the housing of the electrical switch and circumscribing the aperture of the housing of the electrical switch.

9. A sealing assembly according to claim 1, wherein the engagement element includes a rigid further abutment portion and the sealing element includes a further complementary abutment portion for sliding engagement with the further abutment portion of the engagement element, wherein retention of the sealing element by the engagement element causes sealing engagement between the further complementary abutment portion of the sealing element and the further abutment portion as the further complementary abutment portion is urged against the further abutment portion of the engagement element so as to further occlude passage and ingress of particulates and water from external of the further abutment portion to the aperture extending through the outer surface of a housing of the electrical switch.

10. A sealing assembly according to claim 1, wherein the sealing element is formed from an elastically resilient polymeric material including those selected from the group including a urethane such as thermoplastic polyurethane, synthetic rubber, silicone, a silicone rubber or the like.

11. A sealing assembly according to claim 1, wherein the actuator of the electrical switch is operable by urging an actuation portion in communication with the actuator which extends through the aperture in the linear direction of movement by a user.

12. A sealing assembly according to claim 11, wherein the actuation portion extends through the sealing element and the sealing element is sealingly engaged and affixed to the actuation portion so as to occlude passage and ingress of particulates and water from external of the housing of the electrical switch through the outer surface of a housing of the electrical switch.

13. A sealing assembly according to claim 12, wherein urging of the actuation portion urges the actuator and the sealing element in the direction of movement.

14. A sealing assembly according to claim 12, wherein urging of the sealing element in the direction of movement urges the actuation portion which urges the actuator in the direction of movement.

15. A sealing assembly according to claim 12, wherein urging of the sealing element in the direction of movement urges the actuation portion which urges the actuator in the direction of movement.

16. A sealing assembly according to claim 1, wherein the sealing element extends over an actuation portion, such that the actuation portion is encapsulated between the sealing element and internal of the housing.

17. A sealing assembly according to claim 16, wherein upon urging the actuation portion by the sealing element, the actuator is urged in the direction of movement and the sealing element is urged in the direction of movement by the actuation portion.

18. A sealing assembly according to claim 1, wherein the engagement element is integrally formed with a housing of an electrical switch.

* * * * *